US012152217B2

(12) United States Patent
Duron et al.

(10) Patent No.: US 12,152,217 B2
(45) Date of Patent: Nov. 26, 2024

(54) LUBRICATING COMPOSITION FOR REDUCING WEAR AND TEAR ON DLC PARTS USED IN INTERNAL COMBUSTION ENGINES

(71) Applicant: TotalEnergies OneTech, Courbevoie (FR)

(72) Inventors: Isabelle Duron, Solaize (FR); Catherine Charrin, Solaize (FR); Benoit Thiebaut, Solaize (FR); Brian M. Casey, Norwalk, CT (US)

(73) Assignee: TotalEnergies OneTech, Courbevoie (FR)

( * ) Notice: Subject to any disclaimer, the term of this patent is extended or adjusted under 35 U.S.C. 154(b) by 0 days.

(21) Appl. No.: 17/923,023

(22) PCT Filed: May 4, 2021

(86) PCT No.: PCT/EP2021/061692

§ 371 (c)(1),
(2) Date: Nov. 3, 2022

(87) PCT Pub. No.: WO2021/224237

PCT Pub. Date: Nov. 11, 2021

(65) Prior Publication Data

US 2023/0272298 A1 Aug. 31, 2023

(30) Foreign Application Priority Data

May 4, 2020 (EP) ..... 20305428

(51) Int. Cl.

| | |
|---|---|
| ***C10M 135/20*** | (2006.01) |
| ***C10M 137/10*** | (2006.01) |
| ***C10M 141/10*** | (2006.01) |
| *C10N 30/06* | (2006.01) |
| *C10N 40/25* | (2006.01) |

(52) U.S. Cl.
CPC ..... *C10M 135/20* (2013.01); *C10M 137/10* (2013.01); *C10M 141/10* (2013.01); *C10M 2203/003* (2013.01); *C10M 2219/08* (2013.01); *C10M 2223/045* (2013.01); *C10N 2030/06* (2013.01); *C10N 2040/25* (2013.01)

(58) Field of Classification Search
CPC ..... C10M 135/20; C10M 137/10; C10M 141/10; C10M 2203/003; C10M 2219/08; C10M 2223/045; C10M 125/22; C10M 159/18; C10M 2201/066; C10M 2219/068; C10M 2227/066; C10N 2030/06; C10N 2040/25; C10N 2010/04; C10N 2010/12
See application file for complete search history.

(56) References Cited

U.S. PATENT DOCUMENTS

| | | | | |
|---|---|---|---|---|
| 10,767,134 | B1 * | 9/2020 | Casey | C07F 11/005 |
| 2013/0252860 | A1 * | 9/2013 | Komori | F16J 1/16 508/108 |
| 2017/0240837 | A1 | 8/2017 | Casey et al. | |
| 2017/0240838 | A1 | 8/2017 | Casey et al. | |
| 2019/0390131 | A1 | 12/2019 | Watanabe et al. | |

FOREIGN PATENT DOCUMENTS

| | | | |
|---|---|---|---|
| EP | 1 462 508 | A1 | 9/2004 |
| WO | 2017/149119 | A1 | 9/2017 |

OTHER PUBLICATIONS

International Search Report issued in International Patent Application No. PCT/EP2021/061692 dated Jun. 14, 2021.
Extended European Search Report issued in European Patent Application No. 20 30 5428 dated Nov. 6, 2020.

* cited by examiner

*Primary Examiner* — Cephia D Toomer
(74) *Attorney, Agent, or Firm* — TROUTMAN PEPPER HAMILTON SANDERS LLP

(57) ABSTRACT

The present patent application relates to a method for reducing wear and tear on mechanical parts that are in contact with each other in an internal combustion engine by using a lubricating composition comprising:
at least one base oil;
at least one oxothiomolybdate salt; and
at least one anti-wear compound;
wherein at least one of the said parts includes a surface that comprises an amorphous carbon type coating.

11 Claims, No Drawings

LUBRICATING COMPOSITION FOR REDUCING WEAR AND TEAR ON DLC PARTS USED IN INTERNAL COMBUSTION ENGINES

CROSS REFERENCE TO RELATED APPLICATIONS

The present application is a U.S. National Phase Application under 35 U.S.C. § 371 of International Patent Application No. PCT/EP2021/061692 filed May 4, 2021, which claims priority of European Patent Application No. 20305428.3 filed May 4, 2020. The entire contents of which are hereby incorporated by reference.

FIELD OF THE INVENTION

The present invention relates to the field of lubricant compositions that serve to reduce the wear and tear on parts that are in contact with each other, in particular mechanical parts. More particularly, the invention relates to a lubricating composition for internal combustion engines comprising at least one oxothiomolybdate salt for reducing the wear and tear on parts, in particular produced with DLC (Diamond Like Carbon) coating.

BACKGROUND

One of the major objectives of the current automobile industry is the reduction of the consumption of fuel by engines, in particular by motor vehicle engines, and thus the improvement of the "Fuel Economy" of vehicles. Reducing friction in an engine is an effective way to achieve fuel economy. Thus, a number of research studies have been carried out on friction modifiers as well as on the surfaces of mechanical parts. For example, the use of DLC, in particular hydrogenated DLC, makes it possible to reduce the wear and tear on mechanical parts that are subjected to strong tribological stresses (segments, piston pins, valve lifters for distribution, etc.).

Among the friction modifiers, four main groups may be distinguished nanoparticles, polymers, organo-molybdenum compounds, and organic molecules.

Where nanoparticles and polymers are little used at the present time, this is not the case for organo-molybdenum compounds which represent the most important family of friction modifiers. The best known and most widely used organo-molybdenum friction modifiers are molybdenum dithiocarbamates (MoDTC). These organo-molybdenum friction modifiers, although very effective, present certain drawbacks. Indeed, they may induce some fouling or clogging and corrosion of the component parts of the engine. Furthermore, they are only active at high temperatures and can cause deterioration of certain types of surfaces, in particular surfaces comprised of amorphous carbon (Diamond Like Carbon).

In addition, from an ecological point of view, it is necessary to reduce the content of sulfur or phosphorous elements in the lubricating compositions used.

Thus, organic friction modifiers are studied and conventionally used. It has been found that glycerol esters are effective, and in particular glycerol mono-oleate is commercially the most used. It has the advantages of not containing ash, phosphorous or sulfur and of being produced from renewable raw materials. However, its properties as a friction modifier are inferior to those of molybdenum dithiocarbamate.

The use of glycerol ethers as a friction modifier is also known. Thus, the patent application JPS5925890 describes the use of glycerol ethers comprising an alkyl chain that contains from 4 to 28 carbon atoms. The patent application JP2000273481 also describes the use of glycerol ethers comprising an alkyl chain that contains more than 14 carbons as friction modifiers.

There therefore exists an interest in proposing new friction modifiers that effectively contribute to achieving gains in terms of efficiency.

SUMMARY

Thus, an objective of the present invention is to provide a lubricating composition for internal combustion engines that overcomes all or part of the aforementioned drawbacks and makes it possible to reduce the wear and tear on mechanical parts produced with DLC (coating), preferably hydrogenated DLC coating.

Another objective of the present invention is to provide a method for reducing the wear and tear on mechanical parts in an internal combustion engine produced with DLC coating, preferably hydrogenated DLC coating.

The object of the present invention thus relates to method for reducing wear and tear on mechanical parts that are in contact with each other in an internal combustion engine by using a lubricating composition comprising:

At least one base oil;

At least one oxothiomolybdate salt; and

At least one anti-wear compound;

wherein at least one of the said parts includes a surface that comprises an amorphous carbon type coating.

In the context of the present invention, the surfaces with amorphous carbon type coating are also known as DLC for Diamond Like Carbon or Diamond Like Coating as per the accepted terminology. These surfaces have $sp^2$ and $sp^3$ hybridization carbon atoms. Preferably, the surfaces are formed with hydrogenated amorphous carbon, in general terms the hydrogenated amorphous carbon is predominantly $sp^2$ hybridized carbon.

It should be understood that for example MoDTC and MoDTP are not oxothiomolybdate.

The oxothiomolybdate salt may be an ammonium salt or an imidazolium salt.

The oxothiomolybdate salt is preferably:

an ammonium salt having the formula (I)

(I)

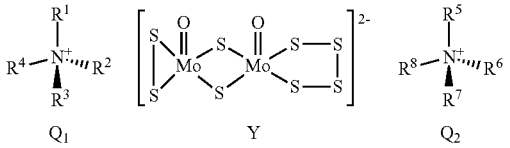

in which $R^1$ to $R^4$ and $R^5$ to $R^8$, which may be identical or different, are selected from the group consisting of hydrocarbyl groups, in a manner such that the total number of carbon atoms of $Q_1$ and $Q_2$ is comprised between 34 and 110, preferably between 42 and 110;

an imidazolium salt having the formula (II)

(II)

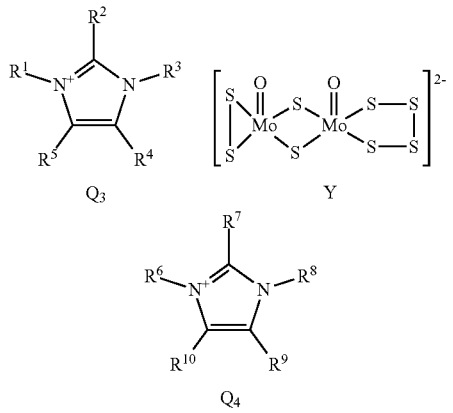

in which $R^1$ to $R^5$ and $R^6$ to $R^{10}$, which may be identical or different, are selected from the group consisting of H, and hydrocarbyl groups, in a manner such that the total number of carbon atoms of $Q_3$ and $Q_4$ is comprised between 62 and 166;

or the mixture thereof.

Preferably, the oxothiomolybdate salt is a compound having the formula (I).

Preferably, the oxothiomolybdate salt is a compound having the formula (II).

In the context of the present invention, for the compounds having the formula (I) the term "hydrocarbyl" is understood to refer to hydrocarbon compounds, which may be linear, branched or cyclic, saturated or unsaturated, and comprising from 1 to 18 carbon atoms, for example from 2 to 16 carbon atoms.

$Q_1$ and $Q_2$ may be identical to, or different from each other, the molar ratio between $Q_1$ and $Q_2$ may be comprised between 100:0 and 0:100.

In the compound having the formula (I), preferably, the total number of carbon atoms is comprised between 42 and 110.

Preferably, the Mo content is comprised between 8.0 and 13.5, and more preferably the Mo content is comprised between 8.0 and 12.6%.

Preferably $Q_1$ and $Q_2$ are identical to each other and are selected from among tetra-n-octylammonium, hexadecyltrimethylammonium, tetradecyltrimethylammonium, octadecyltrimethylammonium, di(tetradecyl)dimethylammonium, di(hexadecyl)dimethylammonium, di(octadecyl)dimethylammonium, tri(tetradecyl)methylammonium, tri(hexadecyl)methylammonium, tri(octadecyl)methylammonium and di(hydrogenated tallowalkyl)dimethylammonium, preferably di(hydrogenated tallowalkyl)dimethylammonium.

Preferably, the compound having the formula (I) is present in an amount that makes it possible to deliver from 10 to 1500 ppm, more preferentially from 280 to 1,400 ppm, for example from 280 to 840 ppm, or from 500 to 1,000 ppm, in particular from 500 to 900 ppm, for example 840 ppm of Mo in the finished product.

The compounds having the formula (I) and the method of preparation thereof are described in particular in the patent document U.S. Pat. No. 10,059,901.

Preferably, in the compounds having the formula (II), the total number of carbon atoms of $Q_3$ and $Q_4$ is comprised between 62 and 166, preferably from 62 to 142, more preferentially from 62 to 118, most preferably from 78 to 118.

In the context of the present invention, for the compounds having the formula (II), the term "hydrocarbyls" is understood to refer to hydrocarbon compounds, which may be linear, branched or cyclic, saturated or unsaturated, and comprising from 0 (in this case it is an H) with 18 carbon atoms, preferably from 1 to 18 carbon atoms.

$Q_3$ and $Q_4$ may be identical to, or different from each other, the molar ratio between $Q_3$ and $Q_4$ may be comprised between 100:0 and 0:100.

In the compound having the formula (II), preferably, the total number of carbon atoms is comprised between 62 and 150.

Preferably, the Mo content is comprised between 7.3 and 13.7%

In one preferred embodiment, in the compound having the formula (II) the total number of total carbon atoms of $Q_3$ and $Q_4$ is comprised between 62 and 78 and the Mo content is comprised between 11.8 and 13.7%.

Preferably $Q_3$ and $Q_4$ are identical to each other and are selected from among 1,3-di-tetradecylimidazolium, 1,3-di-hexadecylimidazolium, and 1,3 dioctadecylimidazolium.

Preferably, the compound having the formula (II) is present in an amount that makes it possible to deliver from 10 to 1500 ppm, preferably from 280 to 1,400 ppm, or from 500 to 1,000 ppm, in particular from 500 to 900 ppm, for example 840 ppm of Mo in the finished product.

The compounds having the formula (II) and the method of preparation thereof are described in particular in the patent document U.S. Pat. No. 9,902,915.

The lubricating composition of the invention comprises from 0.008% to 1.875% by weight of the compound having the formula (I) or (II), preferably from 0.222% to 1.75% by weight, or from 0.040% to 1.25%, more preferentially from 0.667% to 1.05%.

The base oil used in the lubricating compositions of the invention may be oils of mineral or synthetic origin belonging to the groups I to V according to the classes defined by the API (American Petroleum Institute) classification (or their equivalents according to the ATIEL (Association Technique de l'Industrie Européenne des Lubrifiants/Technical Association of the European Lubricants Industry) classification (Table 1) or the mixtures thereof.

TABLE 1

| | Content of Saturated Substances | Sulfur Content | Viscosity Index (VI) |
|---|---|---|---|
| Group I Mineral Oils | <90% | >0.03% | 80 ≤ VI < 120 |
| Group II Hydrocracked Oils | ≥90% | ≤0.03% | 80 ≤ VI < 120 |
| Group III Hydro-Isomerised Oils | ≥90% | ≤0.03% | ≥120 |
| Group IV | Polyalphaolefins (PAO) | | |
| Group V | Esters and other bases not included in the Groups I to IV | | |

The mineral base oils of the invention include any type of base oil that is obtained by means of atmospheric distillation and vacuum distillation of crude oil, followed by refining operations such as solvent extraction, solvent deasphalting, solvent dewaxing, hydrotreating, hydrocracking, hydroisomerisation and hydrofinishing.

Mixtures of synthetic and mineral oils may also be used.

The base oils of the lubricating compositions according to the invention may also be selected from among synthetic oils, such as certain esters of carboxylic acids and alcohols, and polyalphaolefins. The polyalphaolefins used by way of base oil are for example obtained from monomers comprising from 4 to 32 carbon atoms, for example from octene or decene, and for which the viscosity at 100° C. is comprised between 1.5 and 15 $mm^2 \cdot s-1$ according to the standard (from the international standards organization) ASTM D445. Their average molar mass is generally comprised between 250 and 3,000 according to the standard ASTM D5296.

The lubricating composition according to the invention may comprise at least 50% by weight of base oil in relation to the total weight of the composition. In a more advantageous manner, the lubricating composition according to the invention comprises at least 60% by weight, or even at least 70% by weight, of base oils in relation to the total weight of the lubricating composition. More preferably, the lubricating composition according to the invention comprises from 75 to 97% by weight of base oils in relation to the total weight of the composition.

The composition of the invention may also comprise at least one additive.

A large number of additives may be used in the lubricating compositions according to the invention.

The preferred additives for the lubricating composition according to the invention are selected from among detergent additives, friction modifying additives other than the molybdenum compounds defined here above, antioxidants, extreme pressure additives, dispersants, pour point enhancers, anti-foam agents, thickeners and the mixtures thereof.

Preferably, the lubricating compositions according to the invention comprise at least one extreme pressure additive, or a mixture.

The anti-wear additives and extreme pressure additives provide protection with respect to friction of surfaces by forming a protective film adsorbed on its surfaces.

There exists a wide variety of anti-wear additives. Preferably, for the lubricating compositions of the invention, the anti-wear additives are selected from additives that comprise phosphorous and sulfur such as metal alkylthiophosphates, in particular zinc alkylthiophosphate, and more precisely zinc dialkyldithiophosphate or ZnDTP. The preferred compounds are those having the formula Zn((SP(S)(OR)(OR'))2, in which R and R', which may be identical to or different from each other, independently represent an alkyl group, preferably an alkyl group containing from 1 to 18 carbon atoms.

Amine phosphates are also anti-wear additives which may be used in the lubricating compositions of the invention. However, the phosphorous atoms provided by these additives could have the effect of a poison for the catalytic systems of automobiles since they generate ash. It is possible to minimize these effects by substituting a portion of the amine phosphates with additives that do not provide phosphorous, such as for example polysulfides in particular olefins containing sulfur.

Advantageously, the lubricating compositions according to the invention may comprise from 0.01 to 6% by weight, preferably from 0.05 to 4% by weight, more preferentially from 0.1 to 2% by weight in relation to the total weight of the lubricating composition, anti-wear additives and extreme pressure additives.

Advantageously, the lubricating compositions according to the invention comprise from 0.01 to 6% by weight, preferably from 0.05 to 4% by weight, more preferentially from 0.1 to 2% by weight in relation to the total weight of the lubricating composition, anti-wear additives (or anti-wear compound).

Advantageously, the compositions according to the invention may comprise at least one friction modifying additive that is different from the molybdenum compounds of the invention. The friction modifying additives may in particular be selected from the compounds that provide metal elements and ash-free compounds. Among the compounds providing metal elements, mention may be made of transition metal complexes such as Mo, Sb, Sn, Fe, Cu, Zn for which the ligands may be hydrocarbon compounds containing atoms of oxygen, nitrogen, sulfur or phosphorous. The ash-free friction modifying additives are generally organic in origin or may be selected from among fatty acid monoesters and polyol monoesters, alkoxylated amines, alkoxylated fatty amines, fatty epoxides, borates of fatty epoxides, fatty amines or glycerol acid esters. According to the invention, the fatty compounds that comprise at least one hydrocarbon group contain from 10 to 24 carbon atoms.

Advantageously, the lubricating composition according to the invention may comprise from 0.01 to 2% by weight or from 0.01 to 5% by weight, preferably from 0.1 to 1.5% by weight, or from 0.1 to 2% by weight in relation to the total weight of the lubricating composition, friction-modifying additive other than the molybdenum compounds according to the invention.

Advantageously, the lubricating composition according to the invention may comprise at least one antioxidant additive.

The antioxidant additives generally serve to retard the degradation of the lubricating composition. This degradation is most often manifested in the formation of deposits, by the presence of sludge or by an increase in the viscosity of the lubricating composition.

The antioxidant additives generally act as radical scavenger inhibitors or hydroperoxide destroyer inhibitors. Among the antioxidants commonly used, mention may be made of types of antioxidants such as phenolic antioxidants, amine antioxidants, and antioxidants containing sulfur and phosphorous. Certain of these antioxidants, for example those containing sulfur and phosphorous can generate ash. The phenolic antioxidant additives may be free of ash or indeed may be in the form of basic or neutral metal salts. The antioxidant additives may in particular be selected from among sterically hindered phenols, esters of sterically hindered phenols, sterically hindered phenols containing a thioether bridge, diphenylamines, diphenylamines substituted with at least one C1 to C12 alkyl group, N,N'-dialkyl-aryl-diamines and the mixtures thereof.

Preferably according to the invention, the sterically hindered phenols are selected from compounds comprising a phenol group for which at least one of the carbon atoms in the vicinity of the carbon atom carrying the alcohol functional group is substituted by at least one C1 to C10 alkyl group, preferably one C1 to C6 alkyl group, preferably one C4 alkyl group, most preferably one tert-butyl group.

Amine compounds are another class of antioxidant additives that may be used, optionally in combination with phenolic antioxidant additives. Examples of amine compounds are aromatic amines, for example aromatic amines having the formula NRaRbRc in which Ra represents an aliphatic group or an aromatic group, optionally substituted, Rb represents an aromatic group, optionally substituted, Rc represents a hydrogen atom, an alkyl group, an aryl group or a group having the formula RdS(O)zRe in which Rd represents an alkylene or alkenylene group, Re represents an alkyl group, an alkenyl group, or an aryl group, and z represents 0, 1 or 2.

The alkyl phenols containing sulfur or the alkali or alkaline earth metal salts thereof may also be used as antioxidant additives.

Other classes of antioxidant additives are compounds containing copper, for example copper thio-phosphate or copper dithio-phosphate, salts of copper and carboxylic acids, dithiocarbamates, sulfonates, phenates, copper acetylacetonates. salts of copper I and copper II, salts of succinic acid or succinic anhydride may also be used.

The lubricating compositions according to the invention may also comprise any type of antioxidant known to the person skilled in the art.

Advantageously, the lubricating composition comprises at least one antioxidant additive that is ash-free.

Also advantageously the lubricating composition according to the invention comprises from 0.1 to 2% by weight in relation to the total weight of the composition, of at least one antioxidant additive.

The lubricating composition according to the invention may also comprise at least one detergent additive.

The detergent additives generally serve the purpose of reducing the formation of deposits of metal parts on the surface by dissolving the secondary products of oxidation and combustion.

The detergent additives which may be used in the lubricating compositions according to the invention are generally known to the person skilled in the art. The detergent additives may be anionic compounds comprising a long lipophilic hydrocarbon chain and a hydrophobic head. The associated cation can be a metal cation of an alkali or alkaline earth metal.

The detergent additives are preferably selected from among alkali or alkaline earth metal salts of carboxylic acid, sulfonates, salicylates, naphthenates, as well as salts of phenates. The alkali and alkaline earth metals are preferably calcium, magnesium, sodium or barium.

These metal salts generally contain the metal in a stoichiometric amount or in an excess amount, that is to say, in a content level greater than the stoichiometric content. These are then overbased detergents the excess of metal implying the overbased nature of the detergent additive is generally in the form of a metal salt that is insoluble in oil, for example carbonate, hydroxide, oxalate, acetate, glutamate, preferably carbonate.

Advantageously, the lubricating composition according to the invention may comprise from 0.5 to 8% or from 2 to 4% by weight of overbased detergent additives in relation to the total weight of the lubricating composition.

Also in an advantageous manner, the lubricating composition according to the invention may also comprise an additive for reducing the pour point temperature—i.e. pour point depressant additive.

By slowing down the formation of paraffin crystals, the pour point depressant additive generally improves the cold behavior of the lubricating composition according to the invention.

By way of an example of a pour point depressant additive, mention may be made of alkyl polymethacrylates, polyacrylates, polyarylamides, polyalkylphenols, polyalkylnaphthalene, and alkyl polystyrenes.

Advantageously, the lubricating composition according to the invention may also comprise a dispersing agent.

The dispersing agents may be selected from Mannich bases, succinimides and the derivatives thereof.

Also in an advantageous manner, the lubricating composition according to the invention may comprise from 0.2 to 10% by weight of dispersing agent in relation to the total weight of the lubricating composition.

Advantageously, the lubricating composition according to the invention may also comprise at least one additional polymer that improves the viscosity index. By way of an example of an additional polymer that improves the viscosity index, mention may be made of polymeric esters, homopolymers or copolymers, either hydrogenated or not, of styrene, butadiene, and isoprene; and polymethacrylates (PMA). Also, advantageously, the lubricating composition according to the invention may comprise from 1 to 15% by weight in relation to the total weight of the lubricating composition, of the additive that improves the viscosity index.

The lubricating composition according to the invention may also comprise at least one thickening agent.

The lubricating composition according to the invention may also comprise an anti-foaming agent and a demulsifying agent.

Preferably, the lubricating composition of the invention additionally also comprises at least one anti-wear agent, in particular a Zinc-based agent, in particular ZnDTP.

The present invention also relates to the use of the lubricating composition according to the invention in order to reduce the friction of the mechanical parts of an internal combustion engine, at least one of the parts comprising an amorphous carbon type coating, preferably hydrogenated amorphous carbon.

The present invention also relates to a method for reducing the wear and tear on mechanical parts in an internal combustion engine, the method comprising at least one contacting step of bringing the mechanical parts in contact with a lubricating composition according to the invention, at least one of the mechanical parts comprising an amorphous carbon type coating, preferably a hydrogenated amorphous carbon coating.

Preferably, the mechanical parts are mechanical parts of an engine, in particular of a motor vehicle engine, for example a 2-stroke engine or a 4-stroke engine.

The invention will now be described with the aid of the non-limiting examples give here below.

EXAMPLES

The lubricating compositions according to Table 2 here below were prepared.

TABLE 2

| Lubricating Composition | Formulated base oil of grade 0W-08 (% by weight) | Molybdenum Trimer (% by weight) | MoDTC (% by weight) | Oxo Thiomolybdate dimethyl dihydrogenated tallow ammonium (% by weight) | Mo ester (% by weight) | ZnDTP (% by weight) |
|---|---|---|---|---|---|---|
| CC1 | 98.7 | 0.5 | | | | 0.8 |
| CC2 | 98.7 | | 0.5 | | | 0.8 |
| CL1 | 98.7 | | | 0.5 | | 0.8 |
| CL2 | 98.2 | | | 1.0 | | 0.8 |
| CC3 | 98.2 | | 1.0 | | | 0.8 |
| CL3 | 99.5 | | | 0.5 | | |
| CC4 | 99.5 | 0.5 | | | | |
| CC5 | 99.5 | | | | 0.5 | |
| CC6 | 99.5 | | 0.5 | | | |

An HFRR tribological test was carried out for each of the lubricating compositions described in Table 2.

The HFRR (abbreviation for High Frequency Reciprocating Rig, or alternatively ball/plate tribometer) test is carried out on the PCS Instruments HFRR. The test consists of a sliding back and forth movement between a ball measuring 6 mm in diameter and a flat (plate) section with a maximum pressure of 1.4 GPa. The ball is a steel ball covered with a DLC layer and the flat section is made of steel.

The conditions of the test are as follows:

Load (N): 10

Maximum Hertzian stress (GPa): 1.4

Stroke length (mm): 1

Frequency (Hz): 10

Cycles: 144000

Quantity of Oil (ml): 2

Temperature (° C.): 80.

The results of these tests are given in Table 3 here below.

TABLE 3

| Lubricating Composition | Observations | Measurement of depth of wear of the DLC-coated ball |
|---|---|---|
| CC1 | Steel almost visible (almost worn out layer) | 212 μm |
| CC2 | No major wear and low friction | 175 μm |
| CL1 | No major wear and low friction | 139 μm |
| CL2 | No major wear and low friction | 185 μm |
| CC3 | Heavy wear and punctured layer, friction increases | 258 μm |
| CL3 | (start of wear on layer) and unstable friction high/low | 244 μm |
| CC4 | Steel visible (worn out layer) and friction that increases to 0.1 | 250 μm |
| CC5 | Steel visible, layer punctured and no low friction | 206 μm |
| CC6 | Steel visible, layer punctured and friction that rises | 263 μm |

The results show that the lubricating compositions of the invention (CL3) make it possible to effectively reduce the wear and tear on the parts comprising a DLC surface in comparison to the conventional anti-friction additives (CC4, CC5 and CC6).

The results also show that the addition of ZnDTP to the lubricating compositions of the invention (CL1 and CL2), in combination with the oxothiomolybdate salts, makes it possible to improve the properties which serve to reduce the wear and tear of parts that comprise a DLC surface, as compared to the compositions having no ZnDTP (CL3) and as compared to conventional anti-friction additives (CC1, CC2 and CC3).

The invention claimed is:

1. A method for reducing wear and tear on mechanical parts that are in contact with each other in an internal combustion engine by using a lubricating composition comprising:

at least one base oil;

at least one oxothiomolybdate salt; and at least one anti-wear compound;

wherein at least one of the said parts includes a surface that comprises an amorphous carbon type coating, and wherein the oxothiomolybdate salt is neither MoDTC nor MoDTP.

2. The method according to claim 1, in which the oxothiomolybdate salt is an ammonium salt or an imidazolium salt, or a mixture thereof.

3. The method according to claim 2, in which the ammonium oxothiomolybdate salt is a compound having the formula (I)

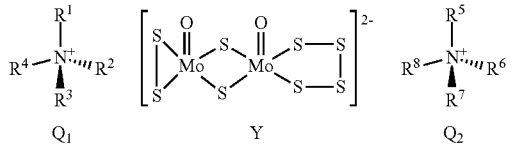

(I)

in which $R^1$ to $R^4$ and $R^5$ to $R^8$, which may be identical or different, are selected from the group consisting of hydrocarbyl groups, in such a manner that the total number of carbon atoms of $Q_1$ and $Q_2$ is comprised between 34 and 110.

4. The method according to claim 2, in which the imidazolium oxothiomolybdate salt is a compound having the formula (II)

(II)

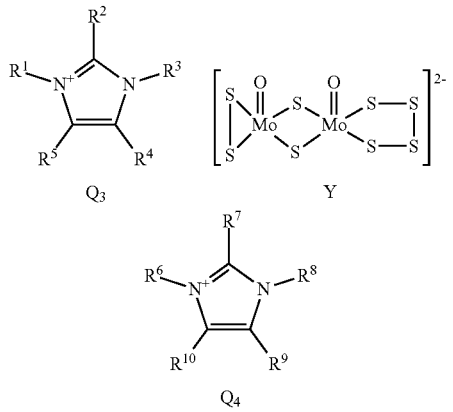

in which $R^1$ to $R^5$ and $R^6$ to $R^{10}$, which may be identical or different, are selected from the group consisting of H, and hydrocarbyl groups, in such a manner that the total number of carbon atoms of $Q_3$ and $Q_4$ is comprised between 62 and 166.

5. The method according to claim 3, in which $Q_1$ and $Q_2$ are identical to each other and are selected from the group consisting of: tetra-n-octylammonium, hexadecyltrimethylammonium, tetradecyltrimethylammonium, octadecyltrimethylammonium, di(tetradecyl)dimethylammonium, di(hexadecyl)dimethylammonium, di(octadecyl)dimethylammonium, tri(tetradecyl)methylammonium, tri(hexadecyl)methylammonium, tri(octadecyl)methylammonium), and di(hydrogenated tallowalkyl)dimethylammonium.

6. The method according to claim 4, in which $Q_3$ and $Q_4$ are identical to each other and are selected from the group consisting of: 1,3-di-tetradecylimidazolium, 1,3-dihexadecylimidazolium, and 1,3-dioctadecylimidazolium.

7. The method according to claim 1, in which the lubricating composition comprises from 0.008% to 1.875% by weight of oxothiomolybdate salt.

8. The method according to claim 1, wherein the anti-wear compound is ZnDTP.

9. A method for reducing the wear and tear on mechanical parts, in an internal combustion engine, the method comprising at least one contacting step of bringing the mechanical parts in contact with a lubricating composition according to claim 1, at least one of the mechanical parts comprising an amorphous carbon type coating.

10. A method for reducing the wear and tear on parts that are in contact with each other, in an internal combustion engine, at least one of the said parts including a surface that comprises an amorphous carbon type coating, by using at least one oxothiomolybdate salt in a lubricating composition, wherein the oxothiomolybdate salt is neither MoDTC nor MoDTP.

11. A method for reducing wear and tear on mechanical parts that are in contact with each other in an internal combustion engine by using a lubricating composition comprising:

at least one base oil;

at least one oxothiomolybdate salt being an ammonium salt or an imidazolium salt, or a mixture thereof; and at least one anti-wear compound;

wherein at least one of the said parts includes a surface that comprises an amorphous carbon type coating, in which the ammonium oxothiomolybdate salt is a compound having the formula (I)

(I)

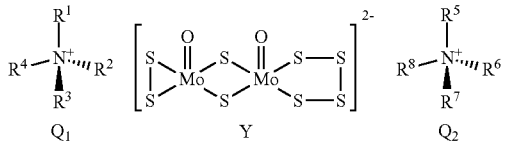

in which $R^1$ to $R^4$ and $R^5$ to $R^8$, which may be identical or different, are selected from the group consisting of hydrocarbyl groups, in such a manner that the total number of carbon atoms of $Q_1$ and $Q_2$ is comprised between 34 and 110, and in which the imidazolium oxothiomolybdate salt is a compound having the formula (II)

(II)

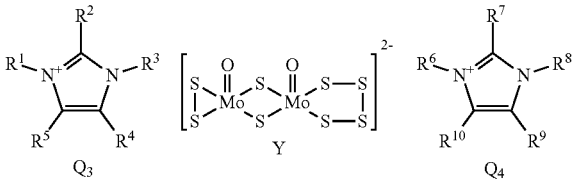

in which $R^1$ to $R^5$ and $R^6$ to $R^{10}$, which may be identical or different, are selected from the group consisting of H, and hydrocarbyl groups, in such a manner that the total number of carbon atoms of $Q_3$ and $Q_4$ is comprised between 62 and 166.

* * * * *